US008294725B2

(12) United States Patent
Iwaki et al.

(10) Patent No.: US 8,294,725 B2
(45) Date of Patent: Oct. 23, 2012

(54) INFORMATION PROCESSING APPARATUS AND DISPLAY CONTROL METHOD

(75) Inventors: Tsutomu Iwaki, Hanno (JP); Koji Hachiya, Akishima (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 212 days.

(21) Appl. No.: 12/777,119

(22) Filed: May 10, 2010

(65) Prior Publication Data

US 2010/0328331 A1 Dec. 30, 2010

(30) Foreign Application Priority Data

Jun. 26, 2009 (JP) ..... 2009-152353

(51) Int. Cl.
*G09G 5/36* (2006.01)

(52) U.S. Cl. ..... 345/547; 345/212

(58) Field of Classification Search ..... 345/547, 345/212

See application file for complete search history.

(56) References Cited

U.S. PATENT DOCUMENTS

| | | | |
|---|---|---|---|
| 6,509,911 | B1 | 1/2003 | Shimotono |
| 7,983,651 | B2 | 7/2011 | Minematsu et al. |
| 2002/0036637 | A1 | 3/2002 | Ogawa |
| 2008/0205316 | A1 | 8/2008 | Minematsu et al. |

FOREIGN PATENT DOCUMENTS

| | | | |
|---|---|---|---|
| JP | H09-269886 | | 10/1997 |
| JP | 2000-163035 | | 6/2000 |
| JP | 2000-163035 | A | 6/2000 |
| JP | 2000-259140 | | 9/2000 |
| JP | 2000-259140 | A | 9/2000 |
| JP | 2001-350549 | | 12/2001 |
| JP | 2002-099248 | | 4/2002 |
| JP | 2002-099248 | A | 4/2002 |
| JP | 2002-312080 | | 10/2002 |
| JP | 2005-115428 | | 4/2005 |
| JP | 2006-294048 | | 10/2006 |
| JP | 2006-294048 | A | 10/2006 |
| JP | 2007-033759 | | 2/2007 |
| JP | 2008-152377 | | 7/2008 |
| JP | 2008-164988 | | 7/2008 |
| JP | 2008-193603 | | 8/2008 |

OTHER PUBLICATIONS

Notice of Reasons for Rejection mailed by the Japan Patent Office on Aug. 17, 2010 in the corresponding Japanese patent app. No. 2009-152353 in 6 pages.

Notice of Reasons for Rejection mailed by the Japan Patent Office on Jan. 4, 2011 in the corresponding Japanese patent app. No. 2009-152353 in 7 pages.

Notice of Reasons for Rejection mailed by the Japan Patent Office on May 31, 2011 in the corresponding Japanese patent app. No. 2009-152353 in 5 pages.

Explanation of Non-English Language References.

*Primary Examiner* — Maurice L McDowell, Jr.

(74) *Attorney, Agent, or Firm* — Knobbe, Martens, Olson & Bear, LLP

(57) ABSTRACT

According to one embodiment, an information processing apparatus comprises video memories each corresponding to each of the display devices, a determination module configured to determine whether an access that satisfies conditions preset with respect to display of the display devices exists in at least one of the video memories, and a changing module configured to change, when the determination module determines that the access that satisfies conditions preset with respect to display of the display devices does not exist in at least one of the video memories, an operation state of a display device corresponding to the at least one of the video memories determined that an access does not exist, from a first operation state to a second operation state having a power consumption lower than a power consumption of the first operation state.

12 Claims, 14 Drawing Sheets

INFORMATION PROCESSING APPARATUS AND DISPLAY CONTROL METHOD

CROSS-REFERENCE TO RELATED APPLICATIONS

This application is based upon and claims the benefit of priority from Japanese Patent Application No. 2009-152353, filed Jun. 26, 2009, the entire contents of which are incorporated herein by reference.

BACKGROUND

1. Field

One embodiment of the present invention relates to an information processing apparatus such as personal computers and a display control method capable of connecting display devices.

2. Description of the Related Art

In general, in the field of personal computers and the like, various power-saving control techniques have been developed so as to reduce their power consumption.

Display Power Management Signaling (DPMS) standardized by Video Electronics Standards Association (VESA) is one of such power-saving control techniques. In DPMS, which is a standard for saving power of display monitors of personal computers, the length of elapsed time after a last key input has been made, for example, is detected through software, and the display monitor is shifted to a power-saving mode (i.e., power is saved) in stepwise.

Recently, configurations of using a plurality of display devices connected to a computer have been increasing in number. Japanese Patent KOKAI Publication No. 2000-163035 discloses a technique in which a computer, to which a plurality of display devices are connected, detects whether an active window exists and whether a cursor is moving in each of the display devices, and shifts display devices in which such detections have not been made to a power-saving mode.

According to the technique of Japanese Patent KOKAI Publication No. 2000-163035, however, there are cases where a display device is not shifted to a power-saving mode, although the user is not actually using the display device. For example, even if a window is in an active mode, there are cases where no actual operations are being made. Therefore, in order to precisely distinguish which display is used by the user from among a plurality of display devices connected to a computer, and shift the other display devices to the power-saving mode, a new function is required.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, an information processing apparatus capable of being connected to display devices, comprises video memories each configured to store a video signal to be output to each of the display devices; a determination module configured to determine whether or not an access that satisfies conditions preset with respect to display of the display device exists in at least one of the video memories; and a changing module configured to change, when the determination module determines that the access that satisfies conditions preset with respect to display of the display devices does not exist in at least one of the video memories, an operation state of a display device corresponding to the at least one of the video memories determined that an access does not exist, from a first operation state to a second operation state having a power consumption lower than a power consumption of the first operation state.

Hereinafter, an embodiment of the present invention will be described with reference to the accompanying drawings.

Figure 1:
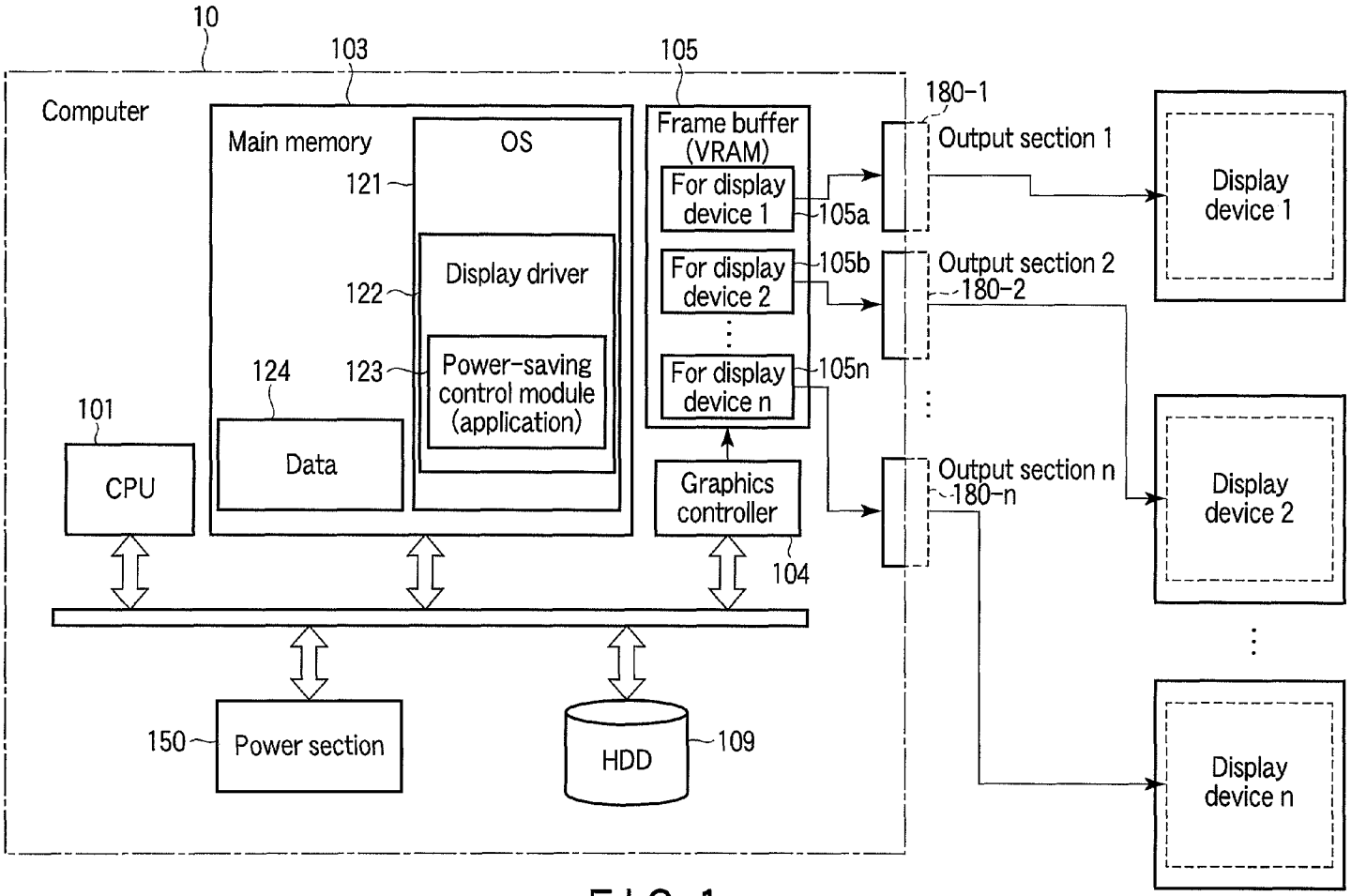
FIG. 1 is an exemplary block diagram schematically illustrating a configuration of an information processing apparatus according to an embodiment of the present invention.

FIG. 1 illustrates a configuration of an information processing apparatus according to an embodiment of the present invention. The information processing apparatus is embodied as a personal computer, for example. The information processing apparatus includes a connection interface capable of connecting a plurality of display devices and a plurality of video memories corresponding to the respective display devices. Accordingly, the information processing apparatus can be used in a multi-display state in which a plurality of display devices are used (i.e., the information processing apparatus comprises a plurality of video memories corresponding to a plurality of display devices and storing video signals to be output to the display devices).

The computer 10 is provided with a central processing unit (CPU) 101, a main memory 103, a graphics controller 104, a frame buffer (video RAM [VRAM]: video memory) 105, output sections 180-1 to **180-*n* for outputting video signals from the frame buffer 105 to display devices 1, 2, . . . , n, respectively, a power section 150, and a hard disc drive (HDD) 109**, as shown.

The CPU 101 is a processor for controlling the operation of the computer 10, and executes various application programs, such as an operating system (OS) 121 loaded from the hard disc drive (HDD) 109 to the main memory 103, a display driver 122, and a power-saving control module (application program) (hereinafter also referred to as power-saving control module [application]) 123. Further, the CPU 101 loads various kinds of data 124 to the main memory 103, as necessary. The display driver 122 controls the graphics controller 104 in cooperation with the OS 121. The control by the display driver 122 and the OS 121 embodies a multi-display function. Further, power-saving control over the display devices 1, 2, . . . , n is implemented by the control of the display driver 122 and the power-saving control module (application) 123, under the control of the CPU 101 as changing means. The power-saving control is embodied as a function of changing (shifting) the operation state of the display device to a power-saving state other than the on-state. Example operation states of the display device other than the on-state include a state in which the display device is powered off, a state in which the refresh rate of the display device is controlled (i.e., the frequency of the refresh rate is lowered), and a state in which the luminance of the display device is controlled (i.e., the luminance of the backlight, for example, is lowered).

The multi-display function is a function of implementing desktop display in the display devices 1, 2, . . . , n at the same time. On each of the desktops, windows of a plurality of applications can be displayed. Screen image data (video signals) of each desktop is stored in a frame buffer 105 (VRAM) provided in the graphics controller 104. Since the frame buffer (VRAM) 105 corresponds to the screen image data of the desktop displayed on each of the display devices 1, 2, . . . , n, only as many frame buffers (VRAM) 105 as there are display devices are provided. For example, as shown, in the frame buffer (VRAM) 105, a frame buffer **105*a* for the display device 1, a frame buffer 105*b* for the display device 2, . . . , and a frame buffer 105*n*** for the display device n.

Further, the graphics controller 104 displays screen image data of the desktops stored in the frame buffer **105*a* for the display device 1, the frame buffer 105*b* for the display device 2, . . . , and the frame buffer 105*n* for the display device n, included in the frame buffers 105 (VRAM), under the control of the display driver 122**.

Figure 2:
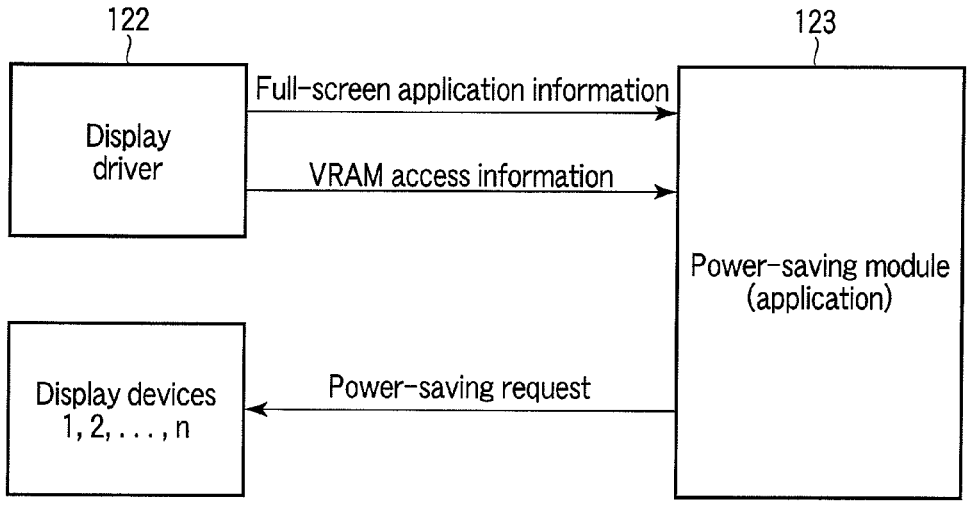
FIG. 2 is an exemplary diagram schematically illustrating a display control process performed by a power-saving control module (application) under the control of a display driver in the information processing apparatus according to the present embodiment.

Next, an outline of the display control process performed by the power-saving control module (application) 123 under the control of the display driver 122 will be described, with reference to FIG. 2.

The display driver 122 manages full-screen application information and VRAM access information. The full-screen application information refers to information determined by the display driver 122 that the screen image data on the desktop to be displayed on each of the display devices 1, 2, . . . , n is a full-screen display. The full-screen display is a state in which the entire screen is displayed using the entire region of the desktop, instead of being displayed in a window, on the screen of the desktop. The VRAM access information is access information (refresh information) stored in the divided regions (divided VRAM region) obtained by dividing storage regions of the frame buffer (VRAM) 105 corresponding to each of the display devices 1, 2, . . . , n into a predetermined number. The refresh information is, for example, the last write time of each divided region, the number of writes per unit of time, and the like. Based on such information, the trend of refresh (access) of each region of the frame buffer (VRAM) 105 can be detected. For example, the display driver 122 detects the direction (lengthwise and lateral directions, for example) of refresh of each region of the frame buffer (VRAM) 105 based on the last write time (access time). Further, the display driver 122 can detect the area of the refreshed region. For example, when the user is inputting a text on a display device, the frame buffer (VRAM) 105 is refreshed in a lateral direction. The display driver 122 detects the refresh direction in the region of the frame buffer (VRAM) 105, and detects the display device corresponding to the frame buffer (VRAM) 105 in which the refresh has been detected as the display device being used by the user. Further, when the user is browsing a Web site, for example, on a display device, the frame buffer (VRAM) 105 is refreshed in a large area in a lengthwise direction. The display driver 122 detects the direction of refresh and the width of refresh in the region of the frame buffer (VRAM) 105, and can detect that the display device corresponding to the frame buffer (VRAM) in which the refresh has been detected is the display device being used by the user. Thus, under the control of the CPU 101 as determination means, the display driver 122 determines whether there is an access to refresh a display of the display device to a predetermined display.

When the power-saving control module (application) 123 receives full-screen application information or VRAM access information from the display driver 122, a display device that is not relevant to the information is detected as a display device not being used by the user. The power-saving control module (application) 123 informs the detected display device of a power-saving request signal for shifting to the power-saving mode, and shifts the informed display device to the power-saving mode (by changing the operation state of the corresponding display device based on the determined result).

Figure 3:
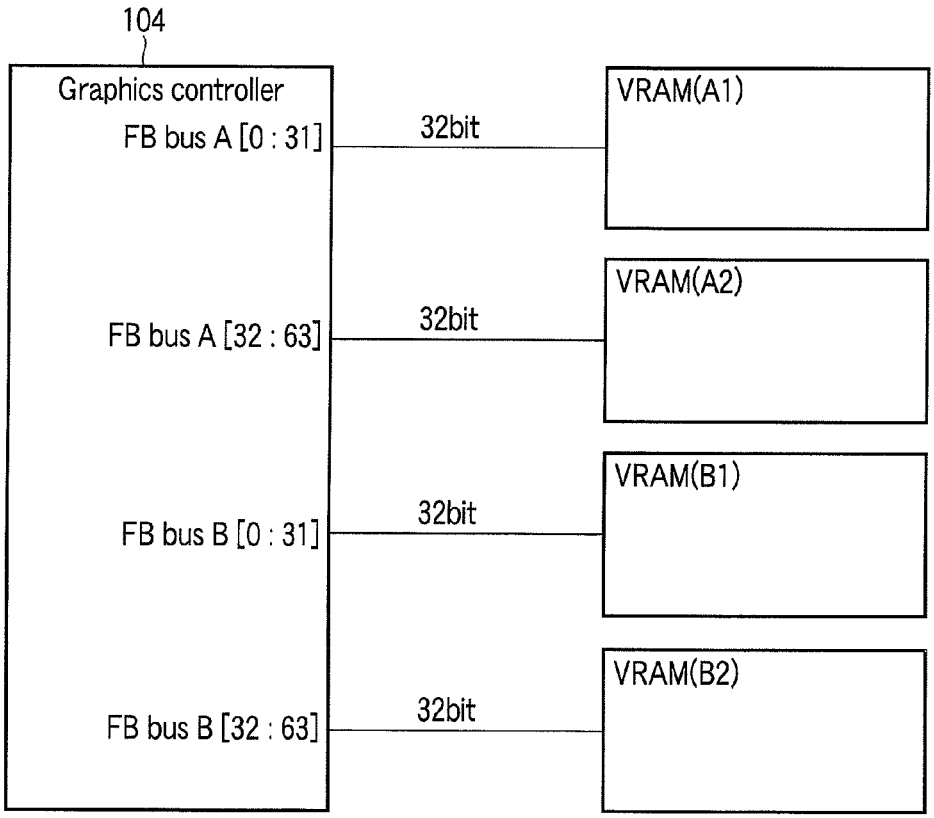
FIG. 3 is an exemplary diagram schematically illustrating a connection state of a graphics controller and a frame buffer (VRAM) included in the information processing apparatus of the present embodiment.

FIG. 3 schematically shows a connection state between the graphics controller 104 and the frame buffer (VRAM) 105. The frame buffer (VRAM) 105 is provided with four physical VRAMs, including VRAM (A1), VRAM (A2), VRAM (B1), and VRAM (B2), for example. Further, the graphics controller 104 is provided with fully buffered (FB) buses A and B. For example, the VRAM (A1) and the VRAM (A2) are connected using a 32-bit width of the FB bus A, and the VRAM (B1) and the VRAM (B2) are connected using a 32-bit width of the FB bus B.

Figure 4:
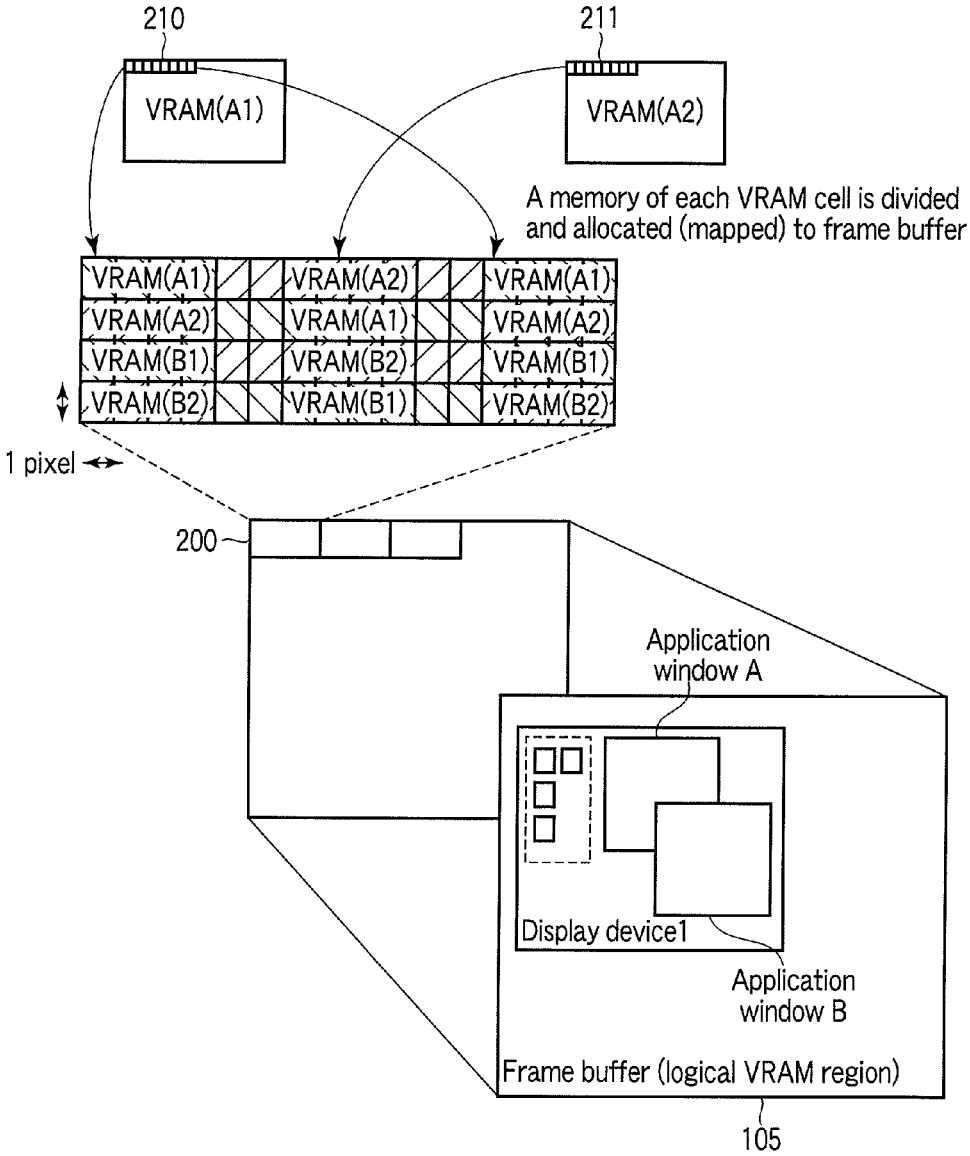
FIG. 4 is an exemplary diagram schematically illustrating a state in which four physical VRAMs included in the information processing apparatus of the present embodiment are mapped in a logical space.

Using the physical VRAMs with the above-described configuration, a frame buffer (hereinafter also referred to as a logical VRAM region) 105 as a memory region is generated by mapping the physical VRAMs in a logical space. FIG. 4 schematically shows the state to which the above-described four physical VRAMs are mapped in a logical space.

In the frame buffer 105, screen images of desktops of the display devices (such as the display devices 1, 2, . . . , n) connected to the computer 10 is stored. In the frame buffer 105, a memory of each cell of the above-described physical VRAMs is divided and mapped (allocated). For example, a cell 210 divided from the VRAM (A1) is mapped to a region in a region 200 divided from the logical VRAM region, which is the frame buffer 105. The cells 211 divided from the VRAM (A2) are sequentially mapped in regions in the region 200 divided from the logical VRAM region, which is the frame buffer 105, for example. Similarly, cells divided from the VRAM (A1) and the VRAM (A2) are alternately mapped in regions in the region 200. Further, cells divided from the VRAM (B1) and cells divided from VRAM (B2) are alternately mapped in regions in the region 200. In this way, cells of each physical VRAM are mapped in regions in the region 200 divided from the logical VRAM region that is the frame buffer 105.

Thus, a memory region to be used by various applications, such as the OS 121 and the power-saving control module (application) 122, are generated.

Figure 5:
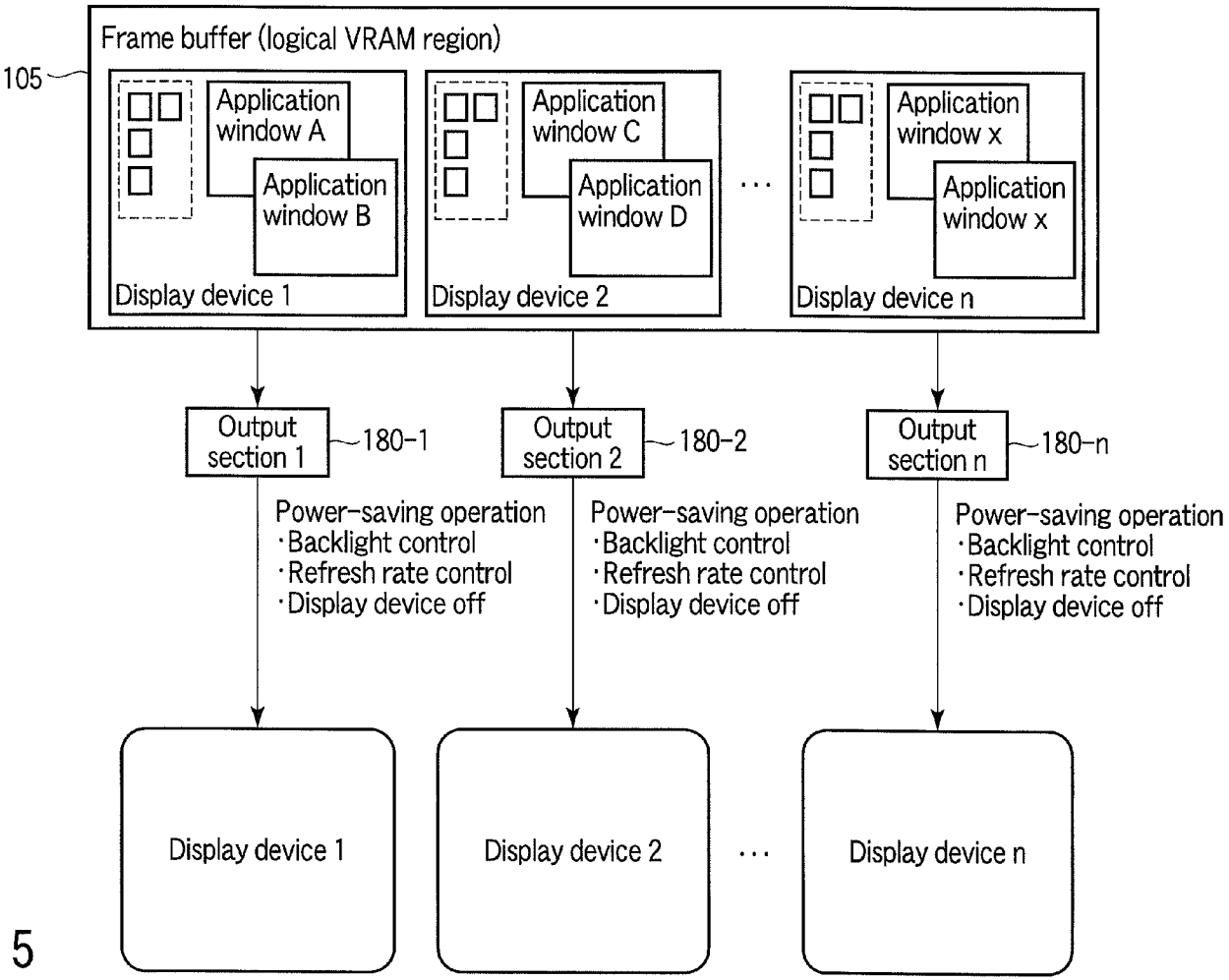
FIG. 5 is an exemplary diagram schematically illustrating a configuration in which a video signal is output from a frame buffer (logical VRAM region) included in the information processing apparatus of the present embodiment to a plurality of display devices via an output section.

FIG. 5 schematically shows a configuration in which a video signal is output from the frame buffer (logical VRAM region) 105 to a plurality of display devices 1, 2, . . . , n via the output sections 180-1, 180-2, . . . , **180-*n*. The frame buffer (logical VRAM region) 105 stores screen images of desktops to be output to the display devices 1, 2, . . . , n. The screen images (display devices 1, 2, . . . , n) of the desktops are stored in the frame buffer 105*a* for the display device 1, the frame buffer 105*b* for the display device 2, . . . , and the frame buffer 105*n* for the display device n, respectively. The screen images (display devices 1, 2, . . . , n) of the desktops are output to the display devices 1, 2, . . . , n via the output sections 180-1, 180-2, . . . , 180-*n*. In this case, under the control of the CPU 101, when the display driver 122 and the power-saving control module (application) 123 determine that the display device is not used by the user, the power-saving control module (application) 123** informs the corresponding display device of a power-saving request signal for shifting to the power-saving mode, and shifts the informed display device to the power-saving mode. The shift to the power-saving mode is embodied as a function of changing (shifting) the operation state of the display device to a power-saving mode other than on-state. Examples of operation states of the display device other than the on-state include a state in which the display device is powered off, a state in which the refresh rate of the display device is controlled (by reducing the frequency of the refresh rate), and a state in which the luminance of the display device is controlled (by reducing the luminance of the backlight, for example).

Figure 6:
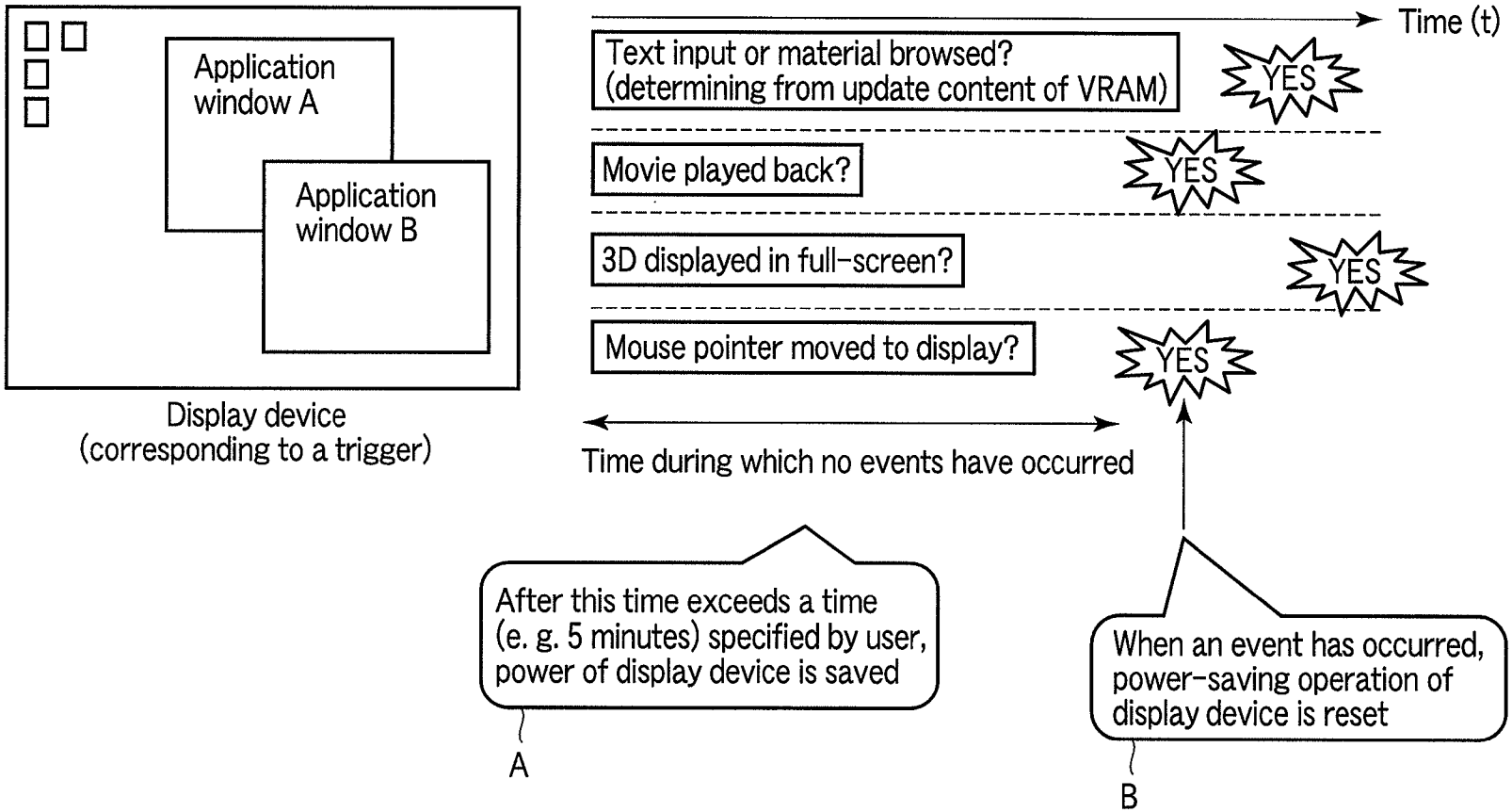
FIG. 6 is an exemplary diagram schematically illustrating a method in which a display driver and a power-saving control module (application) of the information processing apparatus of the present embodiment determines whether a display device is used by the user.

FIG. 6 schematically shows a method in which the display driver 122 and the power-saving control module (application) 123 determine whether the display device is used by the user.

When the display driver 122 and the power-saving control module (application) 123 detect a state that becomes a trigger (i.e., a state in which an access that meets preset conditions exists), the display device is detected as being used by the user, and is controlled so as not to be shifted to the power-saving mode.

Examples of the states that become a trigger include a case where a text input process for a display device is detected, a case where a lengthwise scrolling process is detected, a case where a movie playback process is detected, a case where a full-screen display process of 3D display, for example, is detected, and a case where a mouse pointer (cursor) movement process is detected. The horizontal axis shown in FIG. 6 denotes time, and in the period during which none of the above-described triggers has occurred, when a time (5 minutes, for example) preset by the user has elapsed, a process of shifting the corresponding display device to the power-saving mode is performed (A). On the other hand, when any event of the above-described triggers is detected, and when the corresponding display is in the power-saving mode, the process of resetting the power-saving mode of the display device is performed (B).

Figure 7:
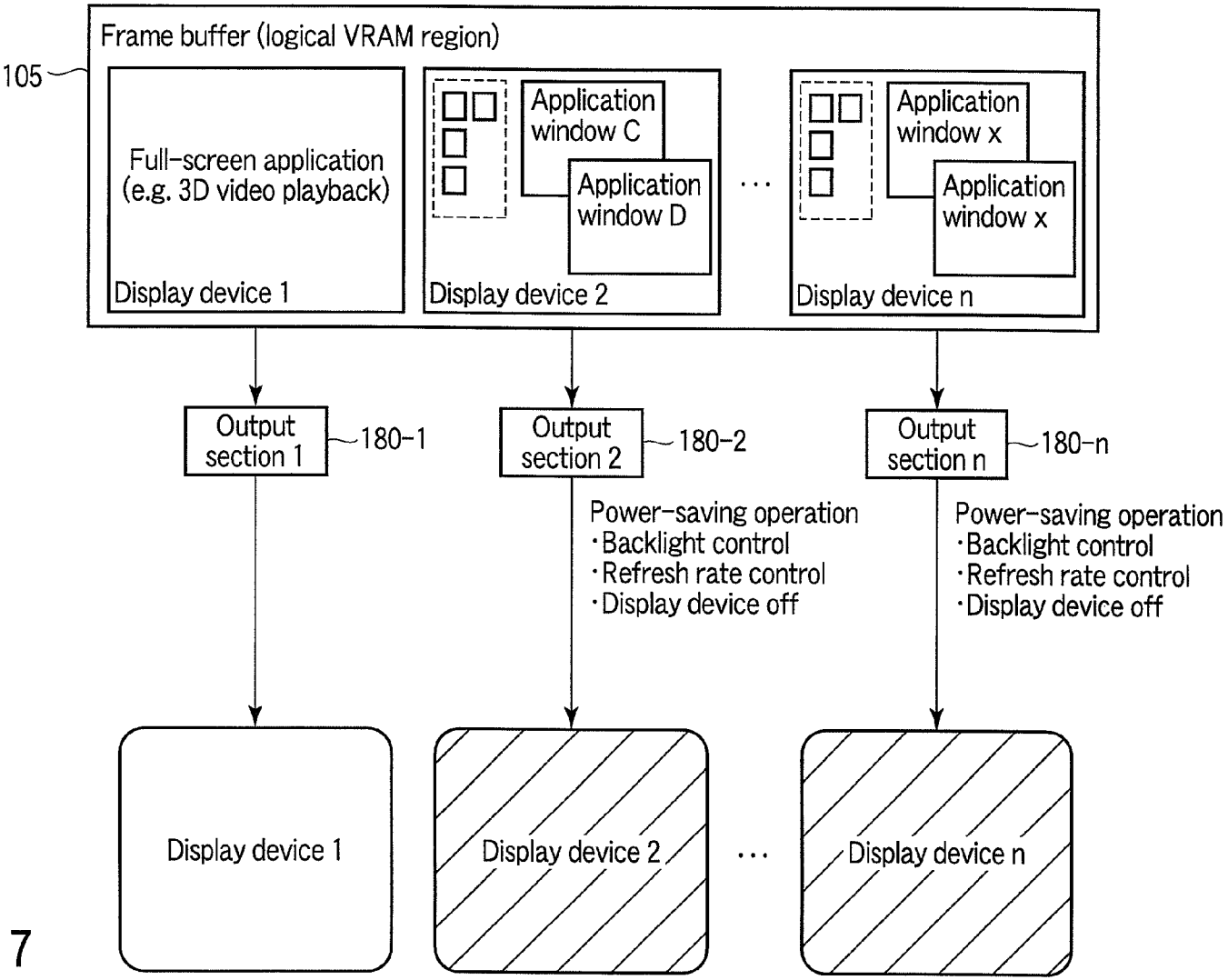
FIG. 7 is an exemplary diagram schematically illustrating a case where at least one of a full-screen display process of 3D display, for example, and a movie playback process, which are triggers used in the information processing apparatus of the present embodiment, is detected.

FIG. 7 schematically shows a case where at least one of the full-screen display process of 3D display, for example, and the movie playback process, which are the above-described triggers, is detected. When at least one of the full-screen display process of 3D display, for example, and the movie playback process is detected for the display device 1, for example, which are the above-described triggers, the display driver 122 informs the power-saving control module (application) 123 of the detected display device. The power-saving control module (application) 123 informs the display devices 2, . . . , n, other than the informed display device 1, of a power-saving request signal for shifting to the power-saving mode. The display devices 2, . . . , n, other than the display device 1, are shifted to the power-saving mode based on the power-saving request signal. When the display driver 122 detects at least one of the full-screen display process of 3D display, for example, and the movie playback process, and when the display device 1 is in a power-saving mode, the power-saving mode of the display device 1 is reset.

Figure 8:
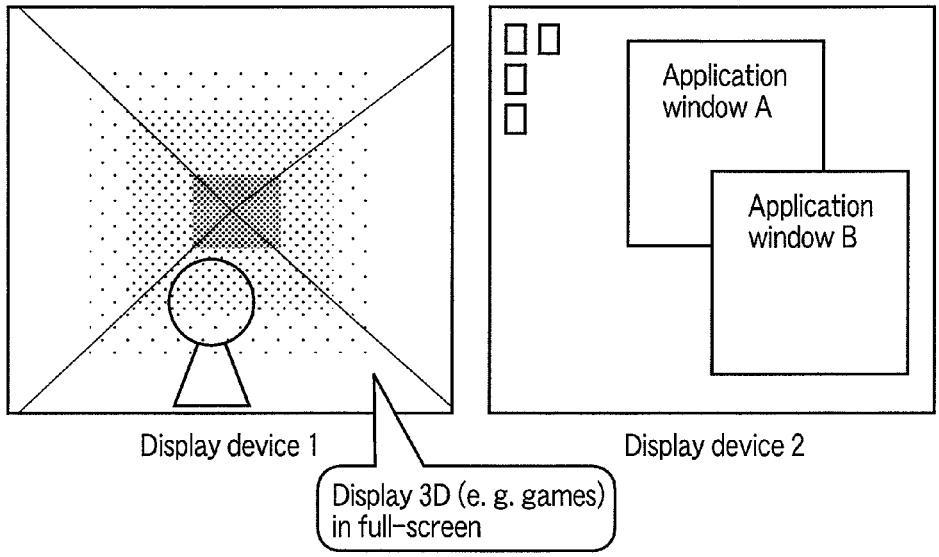
FIG. 8 is an exemplary diagram schematically illustrating a case where a full-screen display process of 3D display, for example, is detected in a display device connected to the information processing apparatus of the present embodiment.

FIG. 8 schematically shows a case where the full-screen display process of 3D display, for example, which is one of the above-described trigger events, is detected for the display device 1. The full-screen display process of 3D display, for example, is detected by the display driver 122, and is informed of the power-saving control module (application) 123. That is, the display device 1, in which the full-screen display process is detected, is not shifted to the power-saving mode. On the other hand, since none of the above-described triggers is detected in the display devices 2, . . . , n, other than the display device 1, in which the full-screen display process is detected, the display devices 2, . . . , n are shifted to a power-saving mode. Detection of the full-screen display process of 3D display, for example, will be described later.

Figure 9:
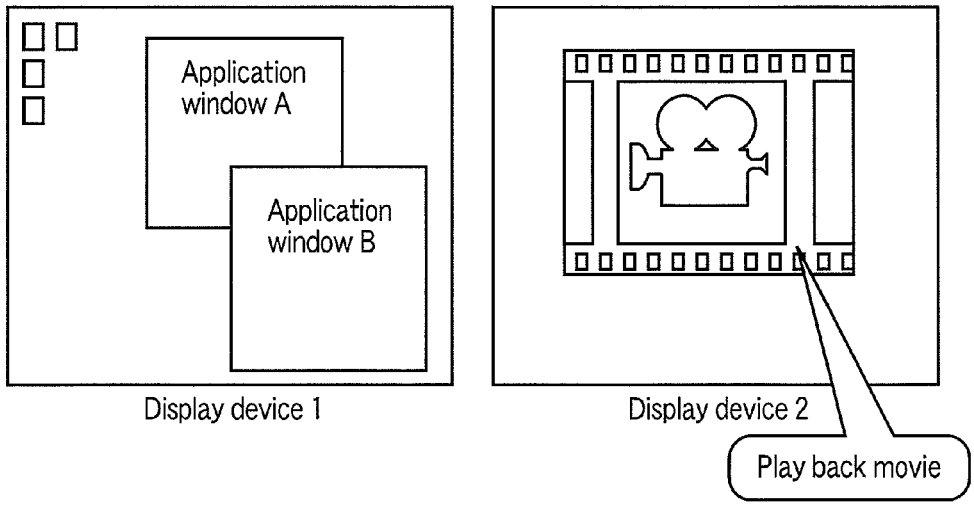
FIG. 9 is an exemplary diagram schematically illustrating a case where a movie playback process is detected in a display device connected to the information processing apparatus of the present embodiment.

FIG. 9 schematically shows a case where a movie playback process, which is one of the above-described triggers, is detected. The movie playback process is detected by the display driver 122, and the power-saving control module (application) 123 is informed of the detected movie playback process. That is, the display device 2, in which the movie playback process is detected, is not shifted to a power-saving mode. On the other hand, since none of the above-described triggers is detected in the display devices 1, . . . , n, other than the display device 2, in which the movie playback process is detected, the display devices 1, . . . , n are shifted to a power-saving mode. Detection of the movie playback process will be described later.

Figure 10:
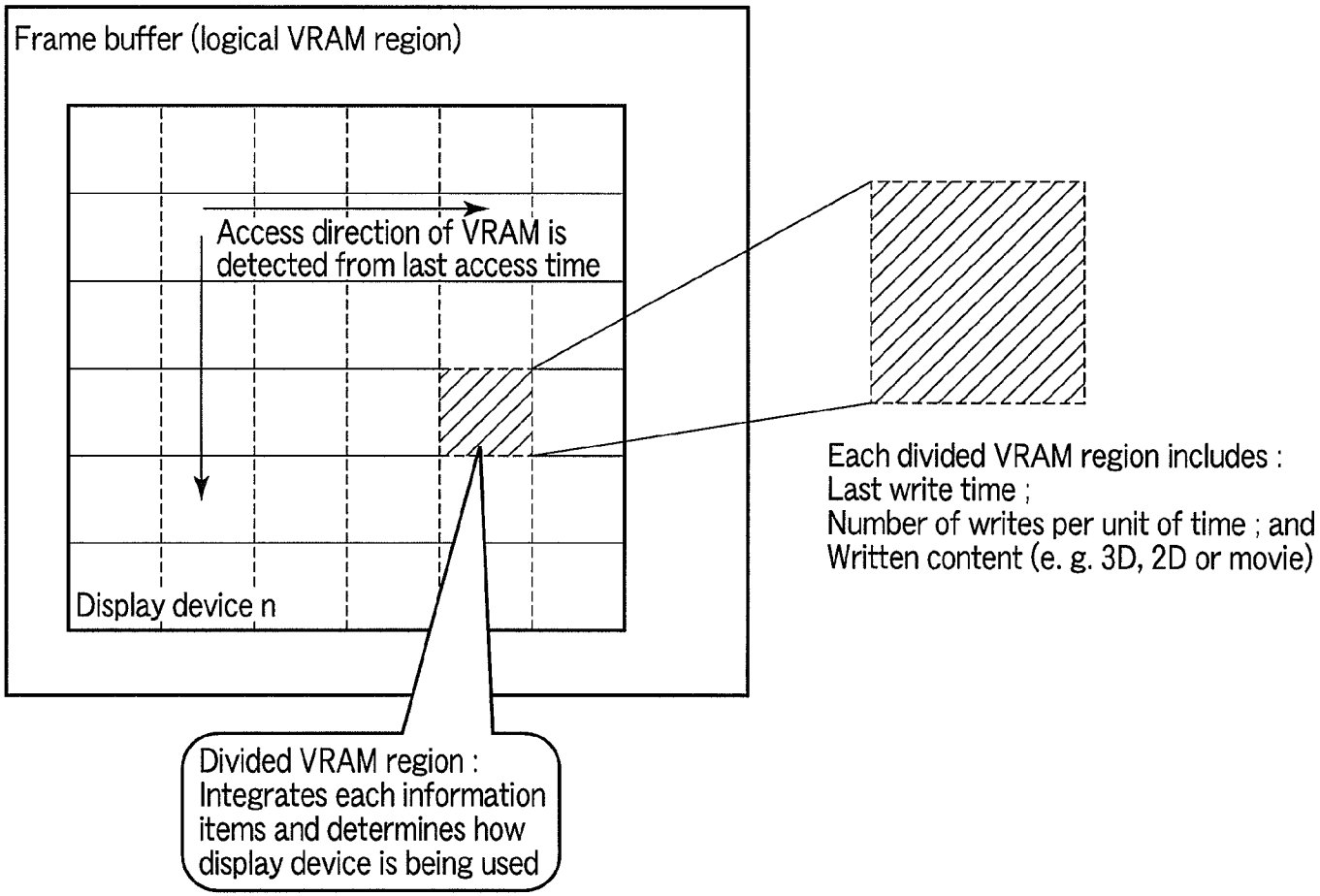
FIG. 10 is an exemplary diagram schematically illustrating a trigger detecting method applied to the information processing apparatus of the present embodiment.

FIG. 10 schematically shows a method of detecting the above-described triggers.

In order to detect the above-described triggers, the frame buffer (logical VRAM region) 105 is divided into 6×6 regions, for example. Each of the divided VRAM regions contains information such as the last write time (last access time), the number of writes per unit of time, and written content (3D, 2D, movie, and text), and the display driver 122 detects such information. Based on the last write time (last access time) of each divided VRAM region, the access direction of the divided VRAM region can be detected. Further, based on the written content of the divided VRAM region (3D, 2D, movie, and text) and information on write region (whether the screen is a full screen or not), detection of the full-screen display process of 3D display, for example, and the playback process of a movie can be performed.

Assuming that the frame buffer (logical VRAM region) 105 is divided into 64 (8×8) regions, the divided VRAM region is expressed as VRAM (x, y). When the division is made into 64, the divided VRAM regions will be expressed as VRAM (0, 0)-VRAM (7, 7). In this case, assume that writing is performed to VRAM (0, 0) of a VRAM. Assume that writing is performed to VRAM (1, 0) at the right part thereof within 5 seconds after the write to VRAM (0, 0). In this case, it is determined that there is high probability that the user has performed a text input in the lateral direction. Similarly, assume that writing is performed to VRAM (0, 1) at the bottom part thereof within 5 seconds after the write to VRAM (1, 0). In this case, it is determined that there is high probability that the user has performed a text input in a lengthwise direction, or started a new line.

Figure 11:
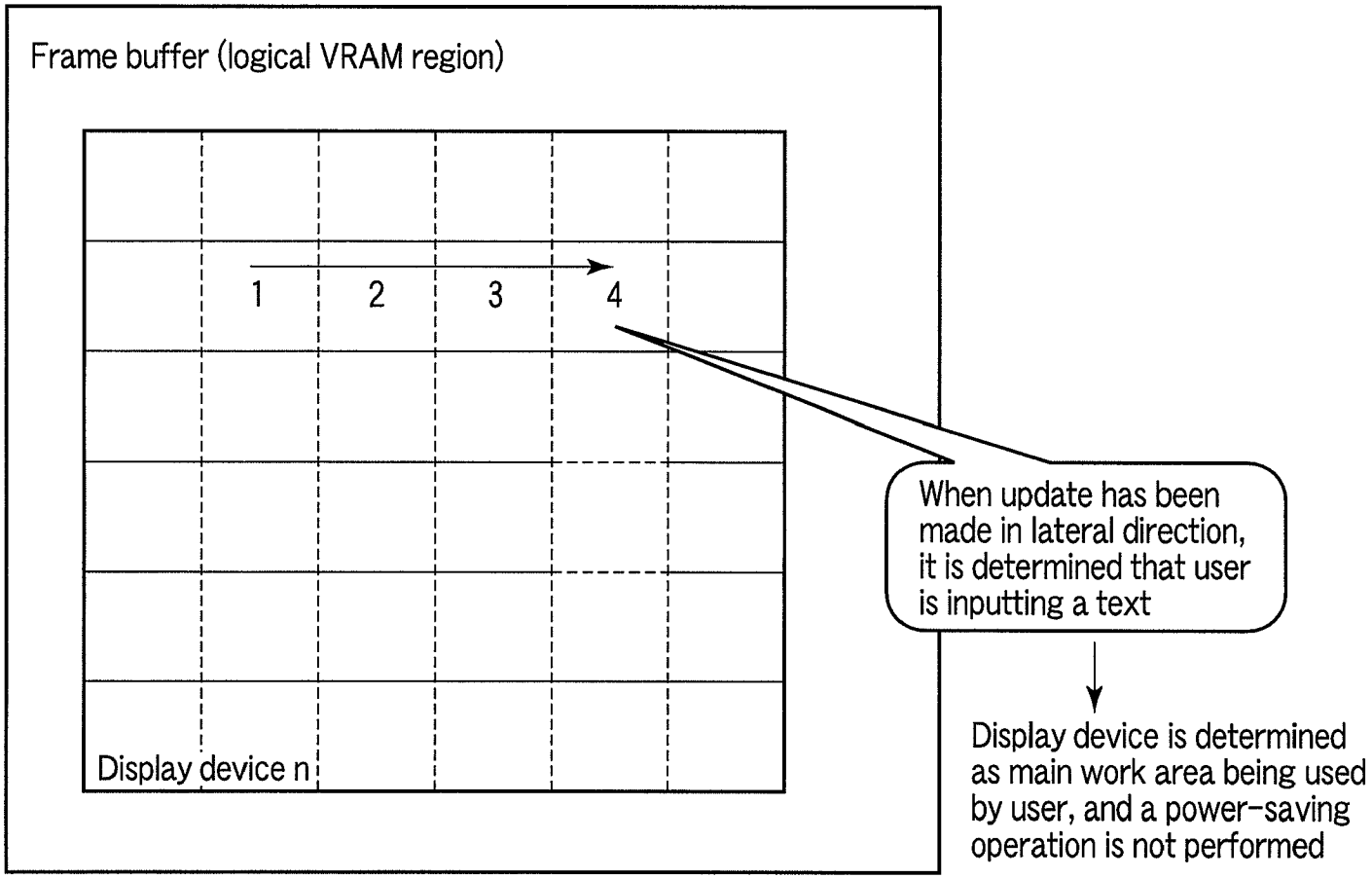
FIG. 11 is an exemplary diagram in which numbers are assigned in chronological order to the last write times (last access times) of divided VRAM regions in a display device connected to the information processing apparatus of the present embodiment.

FIG. 11 shows the last write times (last access times) of the divided VRAM regions in the display device n, in which the numbers assigned in chronological order. The numbers are sequentially arranged in a lateral direction, and the power-saving control module (application) 123 has detected that the divided VRAM regions have been refreshed in a lateral direction. Further, based on the written content (3D, 2D, movie, and text), it is detected that a text input is made to the divided VRAM regions. Accordingly, the display device n is determined as a main work area (display area) being used by the user, on which the user performs input of a text, for example. Therefore, a process of shifting to the power-saving mode is not performed.

Figure 12:
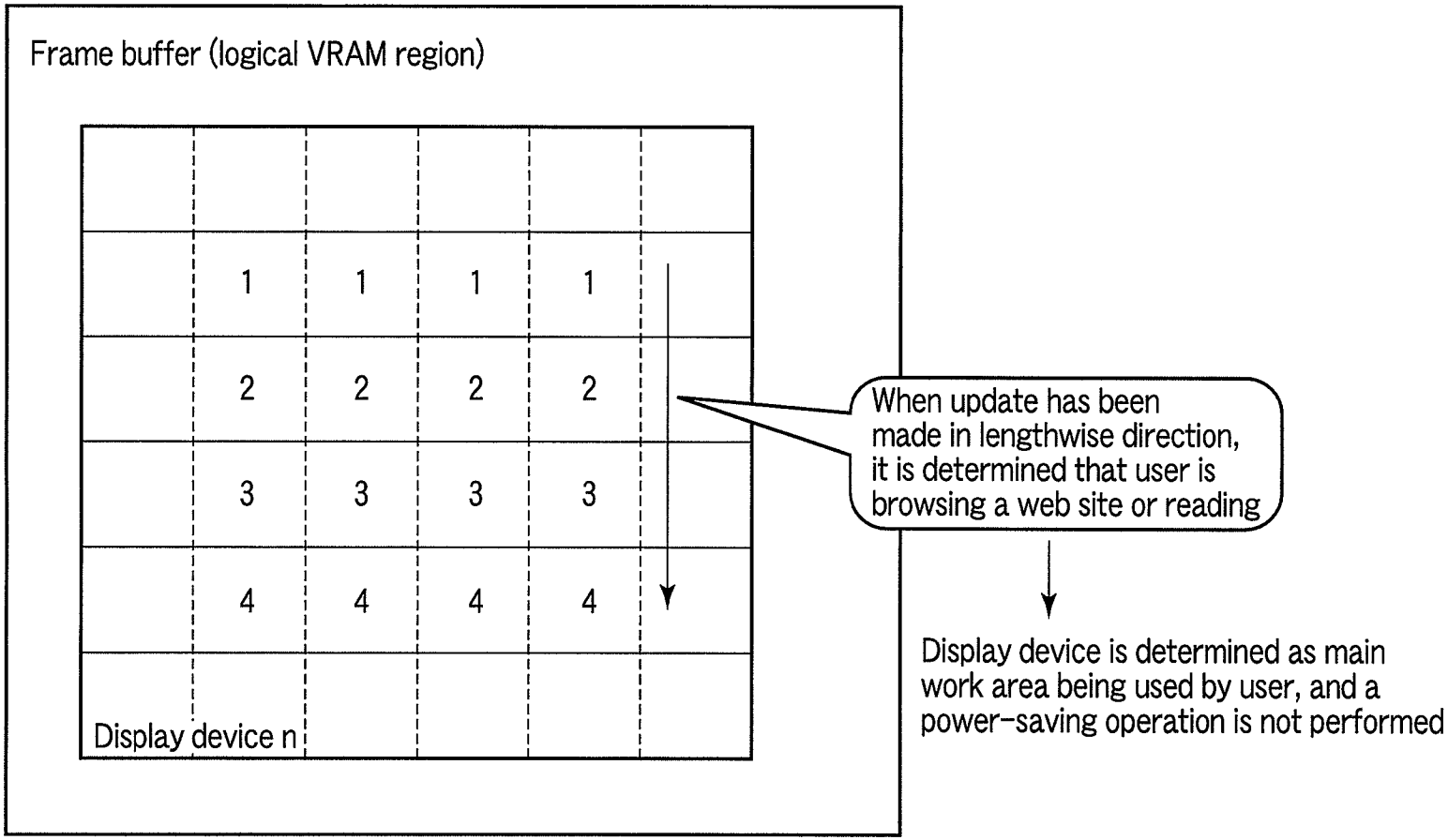
FIG. 12 is an exemplary diagram in which numbers are assigned in chronological order to the last write times (last access times) of divided VRAM regions in a display device connected to the information processing apparatus of the present embodiment.

FIG. 12 shows the last write times (last access times) of each divided VRAM region in the display device n, in which the numbers are assigned in chronological order. The numbers are sequentially arranged in a lengthwise direction, and the display driver 122 is detected that the divided VRAM regions are refreshed in the lengthwise direction. Accordingly, the display device n is scrolled by the user in the lengthwise direction by using a browser, for example, for browse, and is determined as a main work area (display area) being used. Therefore, a process of shifting to the power-saving mode is not performed for the display device n. In the state where a scroll is performed in the lengthwise direction in browse using a browser, for example, the divided VRAM regions are often refreshed in a relatively broad range, compared to the state where the divided VRAM regions are refreshed in the lateral direction as shown in FIG. 11.

Figure 13:
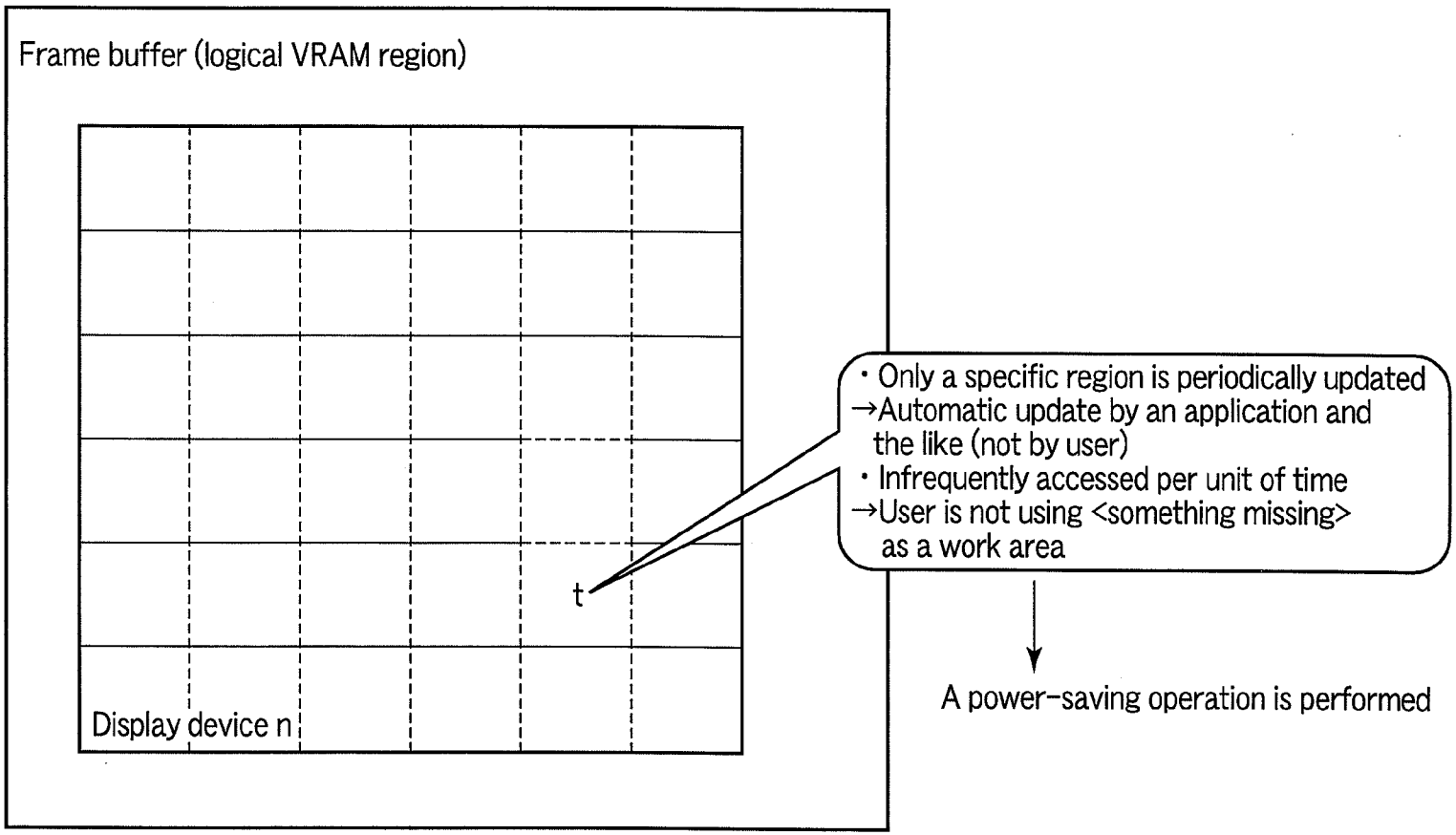
FIG. 13 is an exemplary diagram schematically illustrating a state in which only a predetermined region of a divided VRAM region in a display device connected to the information processing apparatus of the present embodiment is refreshed.

FIG. 13 shows the last write times (last access times) of the divided VRAM regions in the display device n. Only the divided VRAM region t is periodically refreshed. Accordingly, the power-saving control module (application) 123 determines that the refresh is not performed by the user but is automatically performed by an application and the like. That is, the power-saving control module (application) 123 determines that the display device n is not a main work area (display area) being used by the user. Therefore, the power-saving control module (application) 123 performs a process of shifting to the power-saving state after a predetermined time has passed, for example.

Similarly, when a refresh is performed as will be described below, the display device is not determined as being used by the user and is shifted to a power-saving mode after a predetermined time has elapsed. Such cases include when information is written to VRAM (0, 0), and when writing is performed to VRAM (0, 0) again after writing to VRAM (0, 0), and then writing is continually performed to VRAM (0, 0). Refresh of the screen is not regarded as "use of display by the user" by the display driver 122. Refresh of the screen is managed by the display driver 122 and the graphics controller 104, and change of the VRAM caused by the screen refresh and change of the VRAM caused by the text input or browsing by the user can be distinguished. Accordingly, refresh of the screen does not particularly influence the power-saving control. In this case, since an application automatically refreshes a display, there is high probability that writing is performed to the VRAM. Examples of automatic refreshes include news tickers displaying news information, and windows displaying stock information.

Accordingly, such cases are not regarded by the display driver 122 as the display device being used by the user (and the display device is shifted to a power-saving mode after a predetermined time has elapsed).

Figure 14:
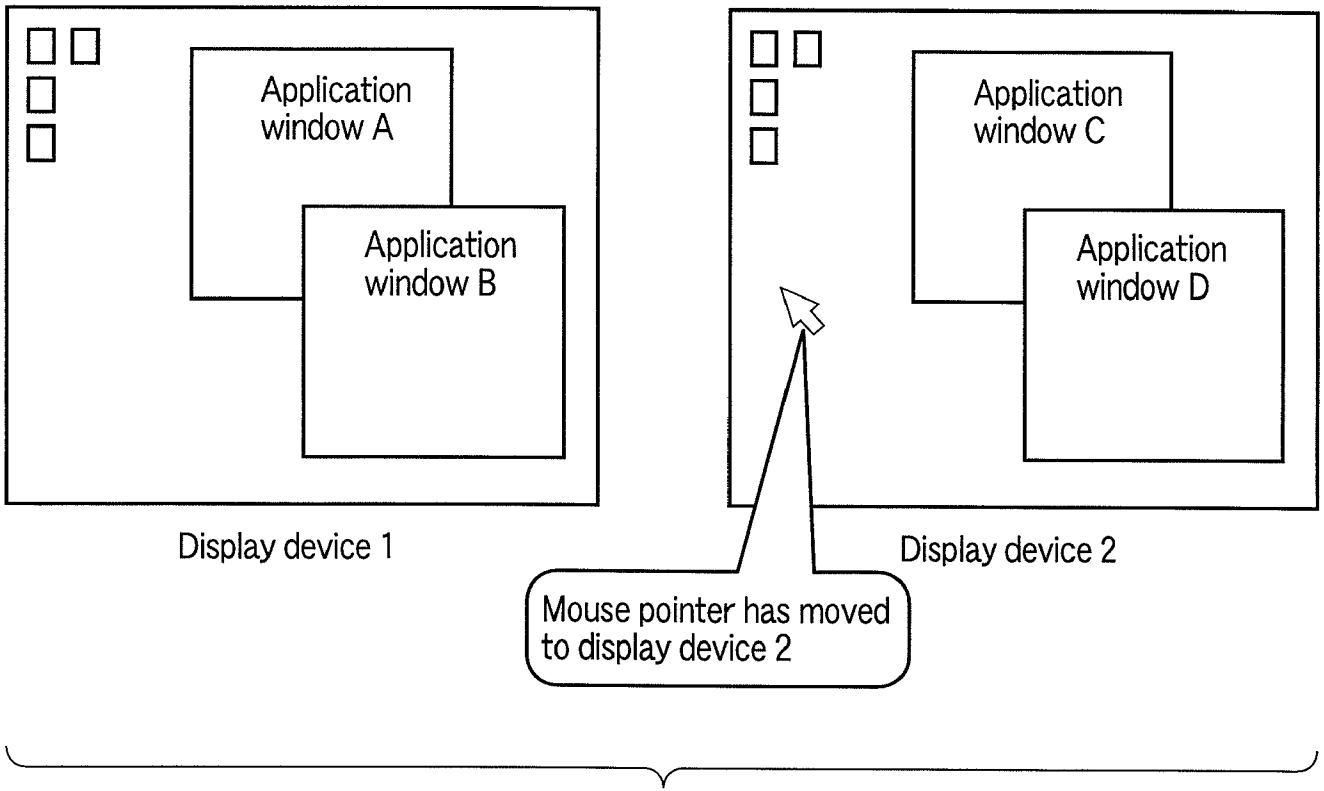
FIG. 14 is an exemplary diagram schematically illustrating a case where movement of a mouse cursor is detected by a display driver of an information processing apparatus of the present embodiment.

FIG. 14 schematically shows a case where the display driver 122 detects a movement of a mouse cursor. For example, when the display driver 122 detects that the mouse cursor of the display device 2 moves from the display device 1, the display device 2 is determined as a main work area (display area) being used by the user. Accordingly, a process of shifting to a power-saving mode is not performed. On the other hand, since a mouse cursor is not detected for the display device 1, the display device 1 is determined as not being a main work area (display area) being used by the user. Accordingly, the power-saving control module (application) 123 performs a process of shifting to a power-saving mode after a predetermined time has elapsed.

As described above, when at least one of the triggers is detected, the process of shifting to the power-saving mode is not performed. On the other hand, when none of the triggers is detected and a predetermined time has elapsed, for example, the process of shifting to the power-saving mode is performed.

Next, the procedure of the display control process performed by the computer 10 of the present embodiment will be described with reference to the flowchart of FIG. 15.

When the display devices 1, 2, . . . , n are connected to the computer 10, a display control process is performed for each of the display devices 1, 2, . . . , n. In the present embodiment, the target of the display control process will be described as the display device n, for example.

The time T (5 minutes, for example), which is specified by the user and after which the display device is set to a power-saving mode, is stored in advance in the HDD 109, for example, of the computer 10 (block S101).

The CPU 101 of the computer 10 loads the display driver 122 and the power-saving control module (application) 123 into the main memory 103. The power-saving control module (application 123) resets t, which is the timer value of counting the time to shift to the power-saving mode, as 0 (block S102). The power-saving control module (application) 123 starts the timer as "t+elapsed time" (block S103). The display driver 122 determines whether writing to a VRAM that is concerned by the user is performed (i.e., whether a trigger is detected) for the display device n (block S104). In block S104, when the display driver 122 determines that the trigger is detected (YES in block S104), the procedure shifts to block S102. On the other hand, when the display driver 122 determines that the trigger is not detected in block S104 (NO in block S104), the display driver 122 determines whether a movie playback process is executed for the display device n (block S105). When the display driver 122 determines that the movie playback process is executed for the display device n in block S105 (YES in block S105), the procedure shifts to block S102. When the display driver 122 does not determines that the movie playback process is not executed on the display device n (NO in block S105), the display driver 122 determines whether a full-screen 3D application is executed on the display device n (block S106). When the display driver 122 determines that a full-screen 3D application is executed on the display device n (YES in block S106), the procedure shifts to block S102. On the other hand, in block S106, when the display driver 122 determines that a full-screen 3D application is not executed on the display device n (NO in block S106), the display driver 122 determines whether a mouse pointer (mouse cursor) is displayed on the display device n (block S107). In block S107, when the display driver 122 determines that a mouse pointer (mouse cursor) is displayed on the display device n (YES in block S107), the procedure shifts to block S102. On the other hand, in block S107, when the display driver 122 determines that a mouse pointer (mouse cursor) is not displayed on the display device n (NO in block S107), the power-saving control module (application) 123 determines whether the relationship $t \geqq T$ is satisfied (block S108). In block S108, when the power-saving control module (application) 123 determines that the relationship $t \geqq T$ is not satisfied (NO in block S108), the procedure shifts to block S103 (a state in which the preset time is not elapsed). When the power-saving control module (application) 123 determines in block S108 that the relationship $t \geqq T$ is satisfied (YES in block S108), a process of shifting the display device n to a power-saving mode (power-saving operation) is performed (block S109).

Figure 16:
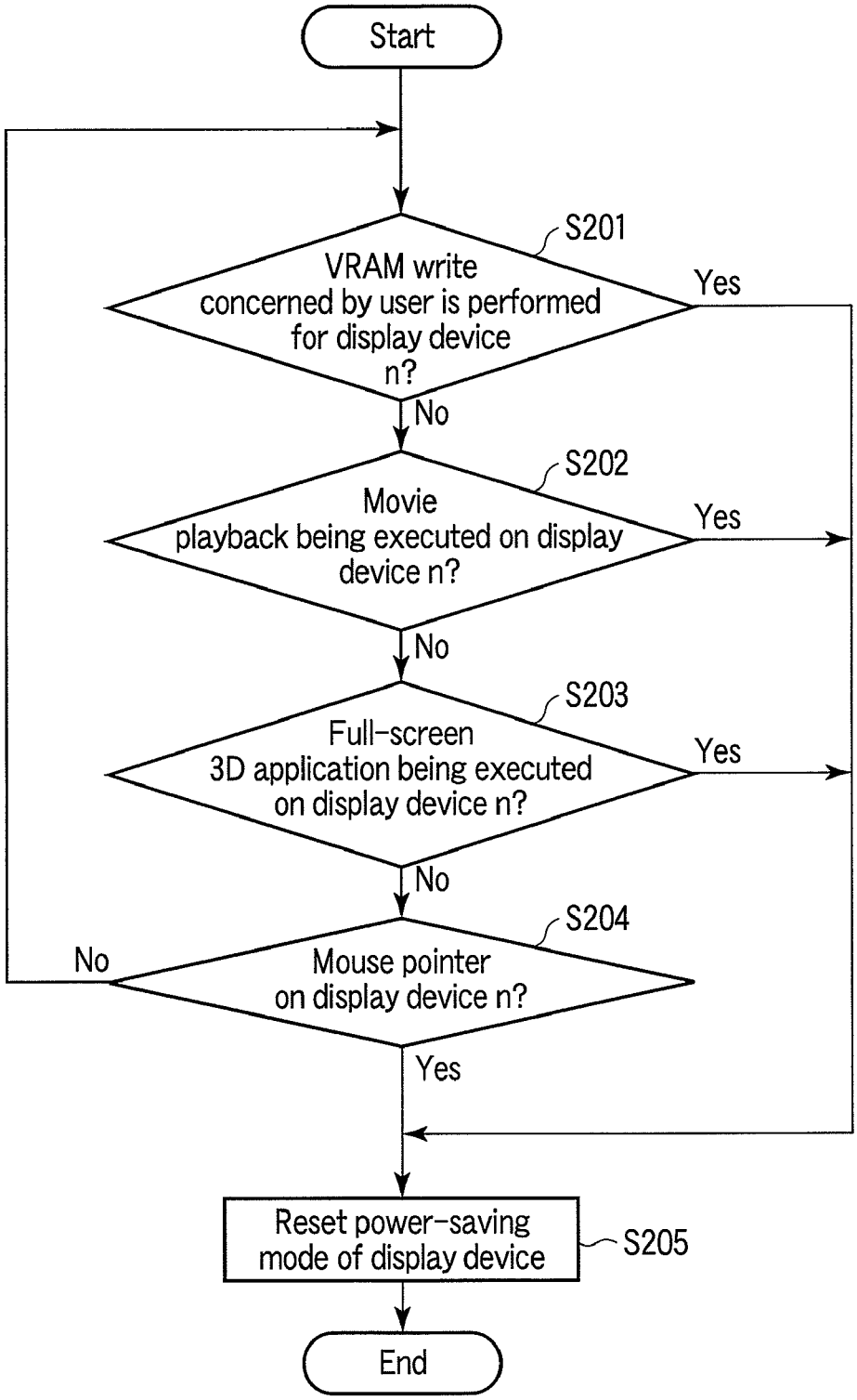
FIG. 16 is an exemplary flowchart illustrating a procedure of a display control process (process of resetting a power-saving mode) executed by a computer, which is the information processing apparatus of the present embodiment.

Next, the procedure of the display control process (process of resetting the power-saving mode) executed by the computer 10 of the present embodiment will be described with reference to the flowchart of FIG. 16.

Figure 15:
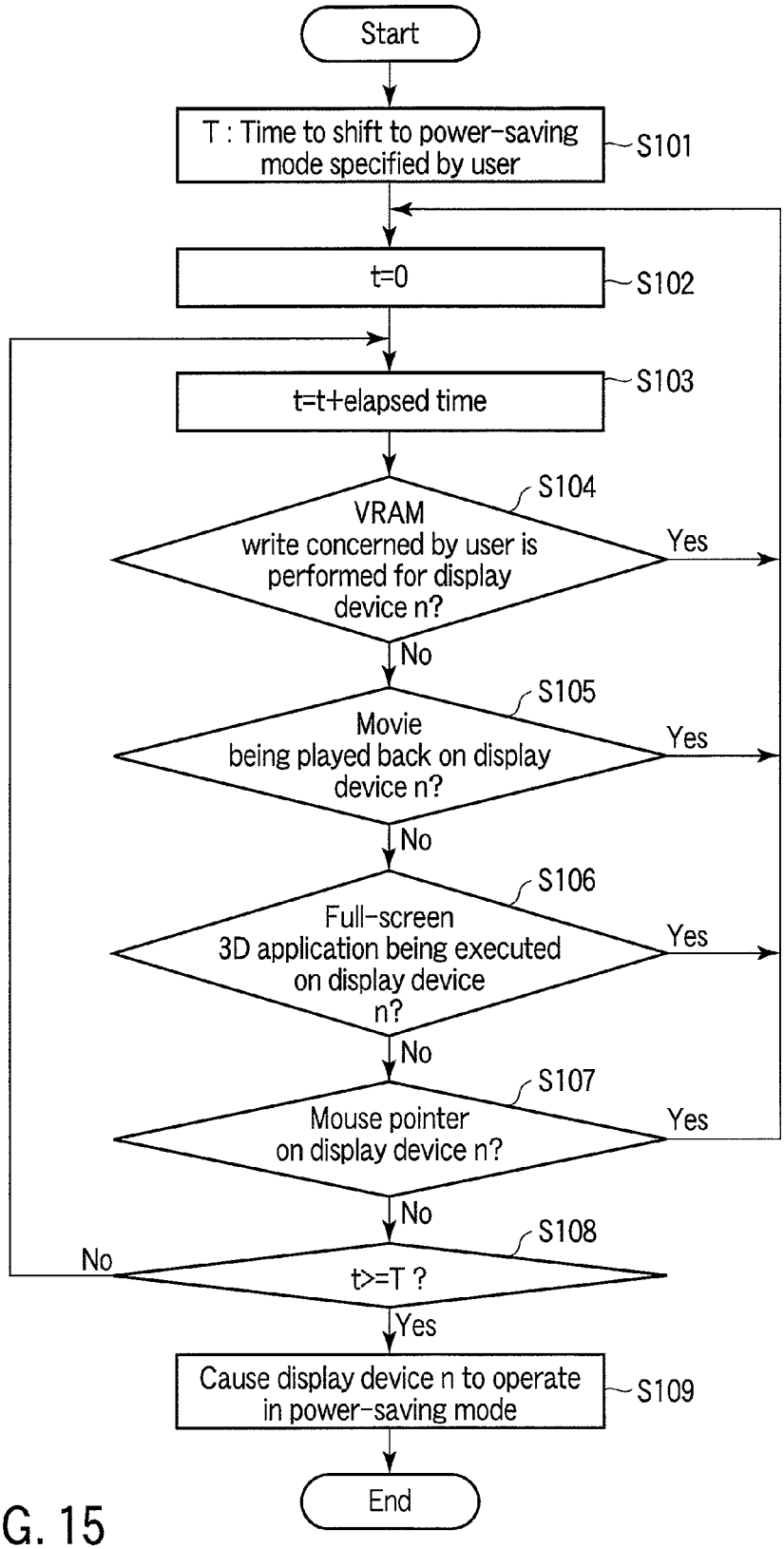
FIG. 15 is an exemplary flow chart illustrating a procedure of a display control process executed by a computer which is the information processing apparatus of the present embodiment.

As in the case of FIG. 15, when a plurality of display devices 1, 2, . . . , n are connected to the computer 10, a display control process (process of resetting the power-saving mode) is performed for each of the display devices 1, 2, . . . , n. In the present embodiment, the target of the display control process will be described as the display device n.

The display driver 122 determines whether writing to a VRAM that is concerned by the user is made (whether a trigger is detected) on the display device n (block S201). In block S201, when the display driver 122 determines that a trigger has been detected (YES in block S201), the power-saving mode of the display device n is reset (block S205). On the other hand, in block S201, when the display driver 122 determines that a trigger is not detected (NO in block S201), the display driver 122 determines whether a movie playback process is executed on the display device n (block S202). In block S202, when the display driver 122 determines that a movie playback process is executed on the display device n (YES in block S202), the power-saving mode of the display device n is reset (block S205). When the display driver 122 determines that a movie playback process is not executed on the display device n in block S202 (NO in block S202), the display driver 122 determines whether a full-screen 3D application is executed on the display device n (block S203). When the display driver 122 determines in block S203 that a full-screen 3D application is executed on the display device n (YES in block S203), the power-saving mode of the display device n is reset (block S205). On the other hand, when the display driver 122 determines that a full-screen 3D application is not executed on the display device n (NO in block S203), the display driver 122 determines whether the mouse pointer (mouse cursor) is displayed on the display device n (block S204). When the display driver 122 determines in block S204 that a mouse pointer (mouse cursor) is displayed on the display device n (YES in block S204), the power-saving mode of the display device n is reset (block S205). On the other hand, in block S204, when the display driver 122 determines that a mouse pointer (mouse cursor) is not displayed on the display device n (NO in block S204), the procedure shifts to block S201.

According to an embodiment of the present invention, there are provided an information processing apparatus and a display control method capable of determining which display device is used by the user, and shifting display devices other than the display device determined as being used by the user to a power-saving mode.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The various modules of the systems described herein can be implemented as software applications, hardware and/or software modules, or components on one or more computers, such as servers. While the various modules are illustrated separately, they may share some or all of the same underlying logic or code. The accompanying claims and their equivalents are intended to cover such forms or modifications as would fall within the scope and spirit of the inventions.

What is claimed is:

1. An information processing apparatus configured to connect to display devices, comprising:

video memories corresponding to the display devices and configured to store video data of different applications to be output to the display devices;

a determination module configured to determine whether at least one of the video memories has gained predetermined accesses relating to display of a display device corresponding to the at least one of the video memories; and a switch configured to switch an operation state of the display device corresponding to the at least one of the video memories that has not gained the predetermined accesses relating to the display of the display device corresponding to the at least one of the video memories from a first operation state to a second operation state comprising a power consumption lower than a power consumption of the first operation state, when the determination module determines that the at least one of the video memories has not gained the predetermined accesses and to switch an operation state of the display device corresponding to the at least one of the video memories that has gained the predetermined accesses from the second operation state to the first operation state, wherein the predetermined accesses comprise performing a full-screen display of the display device, and wherein the second operation state comprises at least one of a state where the display device is powered off, a state where a refresh rate of the display device is lowered, and a state where a luminance of the display device is lowered.

2. The information processing apparatus of claim 1, wherein the predetermined accesses comprise refreshing the display of the display device in a lateral direction, and refreshing the display of the display device in a longitude direction.

3. A display control method of an information processing apparatus configured to connect to display devices, the information processing apparatus comprising video memories corresponding to the display devices and configured to store video data of different applications to be output to the display devices, the method comprising:

determining whether at least one of the video memories has gained predetermined accesses relating to display of a display device corresponding to the at least one of the video memories; and switching an operation state of the display device corresponding to the at least one of the video memories that has not gained the predetermined accesses relating to the display of the display device corresponding to the at least one of the video memories from a first operation state to a second operation state comprising a power consumption lower than a power consumption of the first operation state, when it is determined that the at least one of the video memories has not gained the predetermined accesses and switch an operation state of the display device corresponding to the at least one of the video memories that has gained the predetermined accesses from the second operation state to the first operation state, wherein the predetermined accesses comprise performing a full-screen display of the display device, and wherein the second operation state comprises at least one of a state where the display device is powered off, a state where a refresh rate of the display device is lowered, and a state where a luminance of the display device is lowered.

4. The display control method of claim 3, wherein the predetermined accesses comprise refreshing the display of the display device in a lateral direction, and refreshing the display of the display device in a longitude direction.

5. An information processing apparatus configured to connect to display devices, comprising:

video memories corresponding to the display devices and configured to store video data of different applications to be output to the display devices;

a determination module configured to determine whether at least one of the video memories has gained predetermined accesses relating to display of a display device corresponding to the at least one of the video memories; and a switch configured to switch an operation state of the display device corresponding to the at least one of the video memories that has not gained the predetermined accesses relating to the display of the display device corresponding to the at least one of the video memories from a first operation state to a second operation state comprising a power consumption lower than a power consumption of the first operation state, when the determination module determines that the at least one of the video memories has not gained the predetermined accesses and to switch an operation state of the display device corresponding to the at least one of the video memories that has gained the predetermined accesses from the second operation state to the first operation state, wherein the predetermined accesses comprise displaying a movie on the display device and wherein the second operation state comprises at least one of a state where the display device is powered off, a state where a refresh rate of the display device is lowered, and a state where a luminance of the display device is lowered.

6. The information processing apparatus of claim 5, wherein the predetermined accesses comprise refreshing the display of the display device in a lateral direction, and refreshing the display of the display device in a longitude direction.

7. An information processing apparatus configured to connect to display devices, comprising:

video memories corresponding to the display devices and configured to store video data to be output to the display devices;

a determination module configured to determine whether at least one of the video memories has gained predetermined accesses relating to display of a display device corresponding to the at least one of the video memories; and a switch configured to switch an operation state of the display device corresponding to the at least one of the video memories that has not gained the predetermined accesses relating to the display of the display device corresponding to the at least one of the video memories from a first operation state to a second operation state comprising a power consumption lower than a power consumption of the first operation state, when the determination module determines that the at least one of the video memories has not gained the predetermined accesses and to switch an operation state of the display device corresponding to the at least one of the video memories that has gained the predetermined accesses from the second operation state to the first operation state, wherein the predetermined accesses comprise performing a full-screen display of the display device, and wherein the second operation state comprises at least one of a state where the display device is powered off, a state where a refresh rate of the display device is lowered, and a state where a luminance of the display device is lowered.

8. The information processing apparatus of claim 7, wherein the predetermined accesses comprise refreshing the display of the display device in a lateral direction, and refreshing the display of the display device in a longitude direction.

9. An information processing apparatus configured to connect to display devices, comprising:

video memories corresponding to the display devices and configured to store video data to be output to the display devices;

a determination module configured to determine whether at least one of the video memories has gained predetermined accesses relating to display of a display device corresponding to the at least one of the video memories; and a switch configured to switch an operation state of the display device corresponding to the at least one of the video memories that has not gained the predetermined accesses relating to the display of the display device corresponding to the at least one of the video memories from a first operation state to a second operation state comprising a power consumption lower than a power consumption of the first operation state, when the determination module determines that the at least one of the video memories has not gained the predetermined accesses and to switch an operation state of the display device corresponding to the at least one of the video memories that has gained the predetermined accesses from the second operation state to the first operation state, wherein the predetermined accesses comprise displaying a movie on the display device and wherein the second operation state comprises at least one of a state where the display device is powered off, a state where a refresh rate of the display device is lowered, and a state where a luminance of the display device is lowered.

10. The information processing apparatus of claim 9, wherein the predetermined accesses comprise refreshing the display of the display device in a lateral direction, and refreshing the display of the display device in a longitude direction.

11. A display control method of an information processing apparatus configured to connect to display devices, the information processing apparatus comprising video memories corresponding to the display devices and configured to store video data of different applications to be output to the display devices, the method comprising:

determining whether at least one of the video memories has gained predetermined accesses relating to display of a display device corresponding to the at least one of the video memories; and switching an operation state of the display device corresponding to the at least one of the video memories that has not gained the predetermined accesses relating to the display of the display device corresponding to the at least one of the video memories from a first operation state to a second operation state comprising a power consumption lower than a power consumption of the first operation state, when it is determined that the at least one of the video memories has not gained the predetermined accesses and switch an operation state of the display device corresponding to the at least one of the video memories that has gained the predetermined accesses from the second operation state to the first operation state, wherein the predetermined accesses comprise displaying a movie on the display device and wherein the second operation state comprises at least one of a state where the display device is powered off, a state where a refresh rate of the display device is lowered, and a state where a luminance of the display device is lowered.

12. The display control method of claim 11, wherein the predetermined accesses comprise refreshing the display of the display device in a lateral direction, and refreshing the display of the display device in a longitude direction.

* * * * *